US005141619A

United States Patent [19]

Muret

[11] Patent Number: 5,141,619

[45] Date of Patent: Aug. 25, 1992

[54] ELECTROLYSER HAVING ELECTRODES COUPLED IN ELECTRICAL SERIES ALONG A COMMON VERTICAL WALL

[75] Inventor: Frédéric Muret, Brussels, Belgium

[73] Assignee: Solvay & Cie. S.A., Brussels, Belgium

[21] Appl. No.: 728,538

[22] Filed: Jul. 11, 1991

[30] Foreign Application Priority Data

Jul. 12, 1990 [BE] Belgium ..... 09000714

[51] Int. Cl.[5] ..... C25B 9/04; C25B 11/08; C25B 11/10; C25B 15/08

[52] U.S. Cl. ..... 204/267; 204/270; 204/289; 204/290 R; 204/290 F; 204/293; 204/292

[58] Field of Search ..... 204/268-270, 204/290 R, 290 F, 288-289, 250, 292-293, 253-258, 267

[56] References Cited

U.S. PATENT DOCUMENTS

| | | | |
|---|---|---|---|
| 3,884,792 | 5/1975 | McGilvery | 204/268 X |
| 3,992,279 | 11/1976 | Larsson | 204/290 F X |
| 4,064,031 | 12/1977 | Kamarian | 204/268 X |
| 4,132,622 | 1/1979 | Kenney | 204/270 X |

*Primary Examiner*—Donald R. Valentine

*Attorney, Agent, or Firm*—Robert E. Burns; Emmanuel J. Lobato

[57] ABSTRACT

Electrolyzer comprising at least two elementary electrolysis cells (1), coupled in electrical series along a common vertical wall (6) which comprises two vertical metal plates (10, 11), arranged on either side of a peripheral frame (12) so as to define a vertical chamber (16). One of the plates (10) carries an anode (13) of one of the cells and the other plate (11) carries a cathode (14) of the other cell. The chamber (16) contains a metal mass whose melting temperature is lower than the temperature prevailing in the said chamber when the electrolyzer is in operation. The electrolyzer is suitable for the electrolytic production of sodium chlorate.

17 Claims, 2 Drawing Sheets

FIG. 3
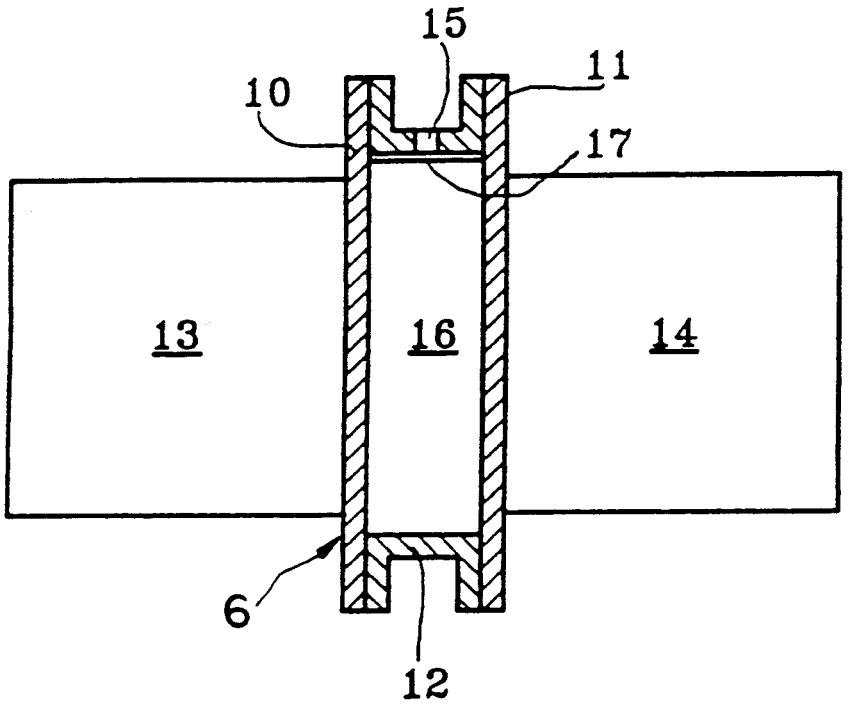
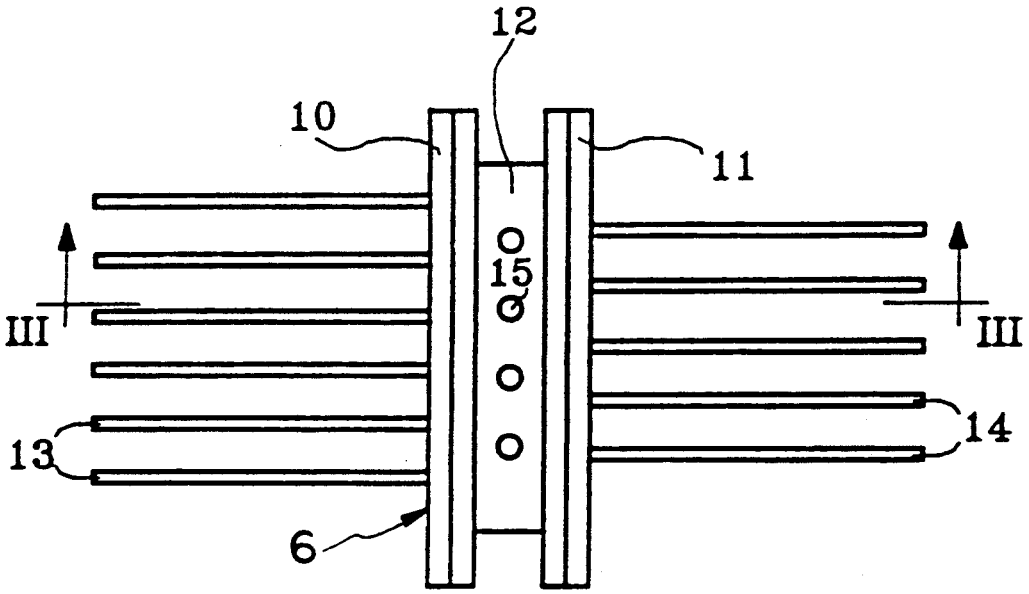
FIG. 2

ELECTROLYSER HAVING ELECTRODES COUPLED IN ELECTRICAL SERIES ALONG A COMMON VERTICAL WALL

The invention relates to electrolysers of the series type, comprising a succession of elementary electrolysis cells coupled electrically in series.

It relates more particularly to an electrolyser in which two successive elementary cells comprise a common vertical metal wall which provides the electrical connection between the cells.

In known electrolysers of this type the common vertical wall of the two cells generally carries on one face an anode of one of the cells and, on the other face, a cathode of the other cell. For this purpose, the common wall is usually made of two plates of different metals, joined integrally to each other, for example by welding. In the case of electrolysers employed for the electrolysis of water or of aqueous solutions, the plate carrying the anode is generally made of titanium, the other plate being made of iron, steel, nickel or of an alloy of these metals. The presence of a titanium plate in combination with a plate of a different metal can result in difficulties in the use of the electrolyser. These difficulties are related to the generation of atomic hydrogen on the cathode during the electrolysis; part of the atomic hydrogen migrates through the plates of the common wall and forms titanium hydride within the titanium plate, resulting in the latter becoming embrittled. Furthermore, there is a risk that molecular hydrogen will form at the junction of the plates of the metal wall, resulting in internal mechanical stresses which can crack the plates or locally break the welded joint responsible for their junction.

To overcome this disadvantage, it has been proposed to place between the titanium plate and the iron, steel or nickel plate a sheet made of a barrier material which has the property of resisting the migration of atomic hydrogen as far as the titanium plate. Tungsten, zinc, boron, silicon, cadmium, carbon, germanium and aluminium are proposed as the barrier material (Patent BE-A-815,411). Although it remedies the formation of titanium hydride, this solution does not avoid the formation of pockets of molecular hydrogen at the junction of the cathode plate and of the sheet of barrier material.

Thought has also been given to maintaining a gap between the two plates of the vertical wall, so as to provide a vertical chamber for the removal of hydrogen after its migration through the plate carrying the cathode (U.S. Pat. No. A-4,088,551). In this known assembly, the electrical connection between the two plates of the vertical wall which is common to the two cells is provided by means of metal studs placed at intervals on the surface of the plates. A similar solution is proposed in Patent GB-A-2,027,053, the chamber defined between the two plates being filled with a porous conductive material, for example a polymeric cellular material filled with metal particles. In these known electrolysers the electrical connection between the two plates is not homogenous and, furthermore, it has an electrical resistance which is not negligible, since it is produced only on a part of the surface of the plates.

The invention overcomes the abovementioned disadvantages of the known electrolysers by providing the means for producing a metal wall which is common to two consecutive electrolysis cells, which reconciles a low electrical resistance and an efficient escape of a gas migrating within the wall.

Consequently, the invention relates to an electrolyser comprising at least two elementary electrolysis cells coupled in electrical series along a common vertical wall which comprises two vertical metal plates, arranged facing each other and forming a vertical chamber between them, one of the plates carrying an anode of one of the cells and the other plate carrying a cathode of the other cell; according to the invention the chamber contains a metal mass whose melting temperature is lower than the temperature prevailing in the said chamber when the electrolyser is in operation.

In the electrolyser according to the invention the two cells are adjoining. One of the plates forms a part of the wall of one of the two cells and carries an anode of this cell, and the other plate forms a part of the wall of the other cell and carries a cathode thereof. The plates may form these electrodes or be used as electrode supports, as is the case, for example, in the cells described in U.S. Pat. No. A-4,088,551. The plates are made of an electrically conductive material capable of withstanding the mechanical, thermal and chemical conditions which normally prevail in the cells when the electrolyser is being used. For example, in the case of an electrolyser intended for the electrolysis of aqueous sodium chloride solutions, the plate carrying the anode may be made of a film-forming metal chosen from titanium, tantalum, niobium, zirconium and tungsten, and the plate carrying the cathode may be made of a material chosen from iron, nickel, cobalt and the alloys of these metals. In the case where the plate of film-forming metal forms at least a part of the anode, this plate is covered, over at least a part of its face which is situated in the cell, with an electrically conductive coating exhibiting a low overvoltage for the oxidation of chloride ions. This coating may, for example, be chosen from metals of the platinum group (platinum, ruthenium, rhodium, palladium, iridium, osmium), alloys of these metals and their oxides; it may advantageously be made of mixed crystals of oxide of a metal of the platinum group and of oxide of a film-forming metal as described above. It is recommended, furthermore, to coat with a nickel film that face of the plate of film-forming metal which is situated inside the vertical chamber. This nickel film can be obtained by any appropriate nickel-plating technique. Its function is to improve the wetting of the plate by the molten metal mass.

The two plates of the wall which is common to the two cells are arranged facing each other, on either side of a peripheral frame, so as to define a vertical chamber. The assembly of the frame and of the plates must be hermetic, so that the chamber can retain a liquid mass during the normal operation of the electrolyser. For this purpose, a frame made of an elastic material can be employed, which is compressed between the two plates, or a rigid frame, for example made of metal or of polymeric material, which is inserted between the two plates, with seals being placed in between, or which is welded or adhesively bonded hermetically to the two plates. It is advisable, furthermore, to provide at least one opening in the upper region of the chamber to permit the escape of gaseous hydrogen out of the chamber. This opening may be arranged through the frame.

According to the invention, the chamber between the two plates contains a metal mass whose melting point is lower than the temperature which normally prevails in the said chamber while the electrolyser is operating normally. The choice of the metal mass will depend on the normal operating temperature of the electrolyser and consequently on the electrolysis process employed. In the case of an electrolyser intended for the electrolysis of water or of aqueous solutions, a metal mass is chosen whose melting temperature is lower than 100° C., for example mercury.

During the normal operation of the electrolyser, the metal mass is responsible for the transfer of the electrical current through the wall which is common to the two cells. Furthermore, being heated to a temperature above its melting temperature, it liquefies; the hydrogen which migrates through the wall and reaches the chamber can thus escape from it by passing through the liquid metal mass.

In a particular embodiment of the electrolyser according to the invention the metal mass has a melting temperature which is higher than room temperature, for example higher than 25° C. This embodiment thus has the special feature that the metal mass is solid at room temperature and liquid at the normal operating temperature of the electrolyser. This embodiment of the invention has the advantage of making the electrolyser easier to assemble and dismantle. Examples of metal masses which can be employed in this embodiment of the invention are the eutectic binary alloy of rubidium (68.0% by weight) and of potassium (32.0% by weight)(melting temperature: 33° C.), the eutectic quaternary alloy of bismuth (49.5% by weight), of lead (17.6% by weight), of tin (11.6% by weight) and of indium (21.3% by weight)(melting temperature: 58.2° C.), the eutectic ternary alloy of indium (51.0% by weight), of bismuth (32.5% by weight) and of tin (16.5% by weight)(melting temperature 60.5° C.), Wood's alloy [quaternary alloy of bismuth (50.0% by weight), of lead (25.0% by weight), of tin (12.5% by weight) and of cadmium (12.5% by weight)(melting temperature: 70° C.)], the eutectic binary alloy of indium (67% by weight) and of bismuth (33% by weight)(melting temperature: 70° C.) and the ternary alloy of bismuth (51.6% by weight), of lead (40.2% by weight) and of cadmium (8.2% by weight)(melting temperature: 91.5° C.). Other examples of metal alloys which can be employed in the electrolyser according to the invention are found in the technical literature (Handbook of Chemistry and Physics, 52nd ed., The Chemical Rubber Co., 1971, page F-18, "Low melting point alloys").

The electrolyser according to the invention is specially adapted for the processes of electrolysis of aqueous sodium chloride solutions using temperatures close to 100° C., for example of between 80 and 120° C. The invention consequently finds an advantageous application in the construction of electrolysers intended for the production of aqueous sodium chlorate solutions by electrolysis of aqueous sodium chloride solutions. It finds another advantageous application in the construction of electrolysers with diaphragms or membranes which are selectively permeable to cations, employed for the production of chlorine and of aqueous sodium hydroxide solutions by electrolysis of aqueous sodium chloride solutions.

Special features and details of the invention will appear during the following description of the attached drawings which show a particular embodiment of the electrolyser according to the invention.

FIG. 2 shows, in plan view, on a larger scale, a detail of the electrolyser of FIG. 1;

FIG. 3 is a section along the plane III—III of FIG. 2.

In these figures, the same reference numbers denote identical components.

Figure 1:
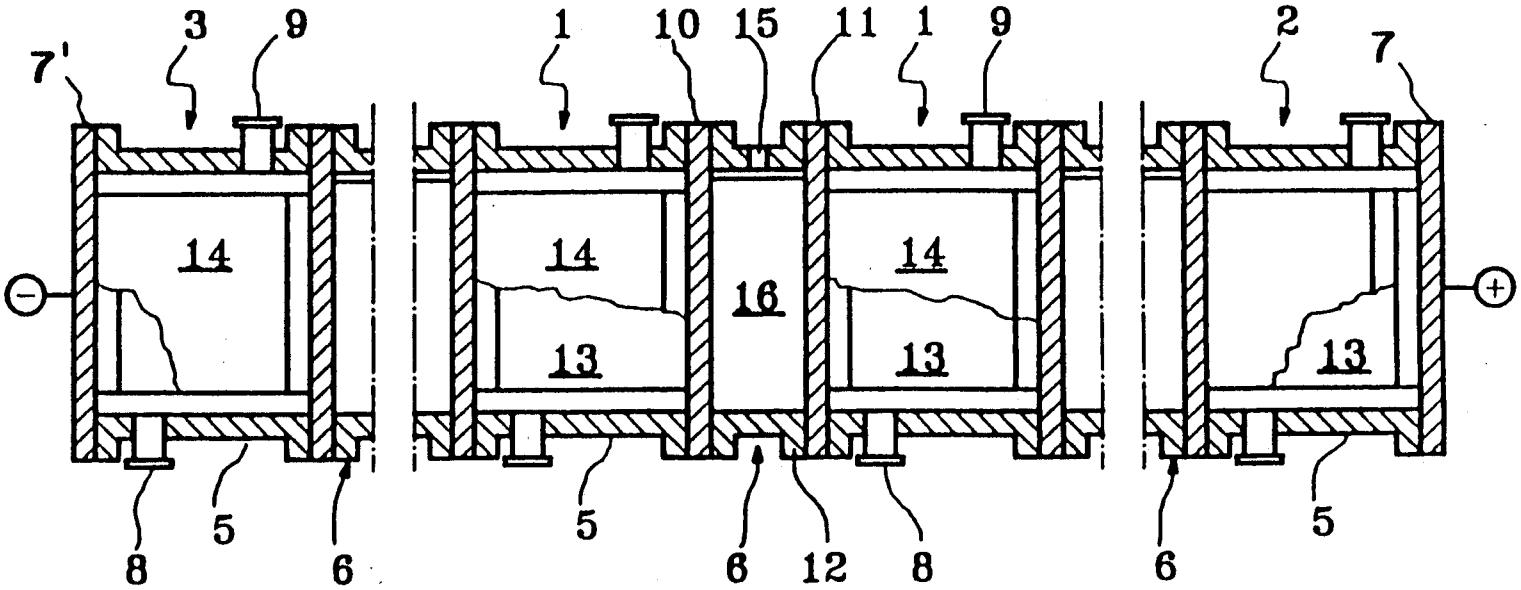
FIG. 1 shows, in vertical lengthwise section with partial cutaways, a particular embodiment of the electrolyser according to the invention.

The electrolyser shown in FIG. 1 is designed for the manufacture of aqueous sodium chlorate solutions by electrolysis of aqueous sodium chloride solutions. It comprises elementary cells 1 placed adjoining between two end elementary cells 2 and 3. The cells 1 comprise an electrolysis chamber defined by a horizontal side wall 5 of rectangular section and two end walls 6 which are common to two adjoining cells. The two end cells 2 and 3 also comprise horizontal side walls 5, end walls 6 placed between them and the adjoining cells 1 and end walls 7, 7' connected to a source of direct current, not shown. Two pipes 8 and 9, communicating with the electrolysis chamber, are intended to be connected, one to a general entry manifold for an aqueous sodium chloride solution, the other to a general manifold for removing the electrolysis products.

FIGS. 2 and 3 show, on a larger scale, the end wall 6 which is common to two adjoining cells. The wall 6 comprises two vertical metal plates 10 and 11 arranged facing each other on either side of a peripheral frame 12. The plate 10 is made of titanium and carries an anode consisting of a series of vertical metal sheets 13 welded transversely to the plate 10. The metal sheets 13 are made of titanium and carry a coating made up of mixed crystals of ruthenium oxide and titanium oxide. The plate 11 is made of steel and carries a cathode consisting of a series of vertical metal plates 14 made of steel, welded to the plate 11. The frame 12 is made of steel and is pierced by a series of openings 15 in its upper part. The plates 10 and 11 are fastened in a leakproof manner to the frame 12, so as to form a leakproof chamber 16. The plates 10 and 11 are, furthermore, fastened in a leakproof manner to the side walls 5 of two adjoining cells. The fastening of the plates 10 and 11 to the frame 12 and to the side walls 5 can be produced by welding. It is preferred to employ an assembly using nuts and bolts, which has the advantage of making it easier to assemble and dismantle the electrolyser.

The end wall 7 of the cell 2 is a titanium plate, identical with plate 10 of the common wall 6 and, like it, it carries an anode consisting of a series of vertical metal sheets 13 made of titanium carrying a coating of titanium oxide and ruthenium oxide. The end wall 7 of the cell 3 is a steel plate, identical with plate 11 of the common wall 6 and, like it, it carries a cathode consisting of vertical metal sheets made of steel 14. The fastening of the plates 7 and 7' to the side walls 5 of the cells 2 and 3 is similar to that of the plates 10 and 11.

In each of the cells 1, 2 and 3, the anode metal sheets 10 alternate with the cathode metal sheets 11.

In accordance with the invention, the chamber 16 of the common wall 6 contains a metal alloy of bismuth (50.0% by weight), of lead (25.0% by weight), of tin (12.5% by weight) and of cadmium (12.5% by weight)-(Wood's alloy) whose melting temperature is approximately 70° C. The alloy fills virtually all of the chamber 16. A small cavity 17 must, however, be provided above the alloy, to permit the latter to expand when the electrolyser is in operation.

To construct the wall 6, it suffices to assemble the plates 10 and 11 to the frame 12 and then to pour into the chamber 16, through the openings 15, the alloy which has been preheated to a temperature above its melting temperature. During the subsequent assembling of the electrolyser, the alloy is present in solid state in the chamber 16.

During the operation of the electrolyser shown in the figures, an aqueous sodium chloride solution is introduced into the electrolysis cells through the pipes 8, and the end walls 7, 7' are connected to the terminals of a source of direct current, not shown. The sodium chloride solution undergoes electrolysis in the electrolysis cells and an aqueous sodium chlorate solution and the hydrogen generated on the metal sheets 14 of the cathodes are collected through the pipes 9. The metal mass present in the chambers 16 melts under the effect of the heat released during the hydrolysis. If atomic hydrogen diffuses through the plate 11 as far as the chamber 16, it bubbles through the liquid metal mass which is present therein and escapes through the openings 15. Furthermore, the liquid metal mass in the chambers 16 ensures the flow of the electrical current between the adjoining cells.

I claim:

1. An electrolyser comprising at least two elementary electrolysis cells coupled in series with one another and having a common vertical wall between said cells, said wall comprising two vertical metal plates which are spaced from one another and a peripheral frame uniting said plates in a leak proof manner to form a chamber between them, an anode carried by one of said plates and disposed in one of said cells, a cathode carried by the other of said plates and disposed in another of said cells, and a metal mass filling at least a substantial portion of said chamber, said metal mass having a melting point below the temperature prevailing in said chamber when said electrolyser is in operation.

2. An electrolyser according to claim 1, in which said frame has, in an upper part thereof, at least one opening for the escape of gas from said chamber.

3. An electrolyser according to claim 1, in which said peripheral frame is of plastic material and is held in compression between said plates.

4. An electrolyser according to claim 1, in which said peripheral frame is of metal and is welded to said plates.

5. An electrolyser according to claim 1, in which said metal mass has a melting point between 25° C. and 100° C.

6. An electrolyser according to claim 1, in which said metal mass is an eutectic binary alloy of rubidium and potassium.

7. An electrolyser according to claim 1, in which said metal mass is an eutectic quaternary alloy of bismuth, lead, tin and indium.

8. An electrolyser according to claim 1, in which said metal mass is an eutectic ternary alloy of indium, bismuth and tin.

9. An electrolyser according to claim 1, in which said metal mass is a quaternary alloy of bismuth, lead, tin and cadmium.

10. An electrolyser according to claim 1 in which said metal mass is an eutectic binary alloy of indium and bismuth.

11. An electrolyser according to claim 1, in which said metal mass is a ternary alloy of bismuth, lead and cadmium.

12. An electrolyser according to claim 1, in which said plate which carries said anode is of a film-forming metal selected from the group consisting of titanium, tantalum, niobium, zirconium, tungsten and alloys of these metals.

13. An electrolyser according to claim 12, in which said plate which carries said anode has, on its face in said chamber, a coating of nickel.

14. An electrolyser according to claim 12, in which said plate which carries said anode is covered over at least a part of its face which is situated in a cell, with a coating of metal of the platinum group consisting of platinum, ruthenium, rhodium, palladium, iridium, and osmium.

15. An electrolyser according to claim 1, in which said plate which carries said cathode is of metal selected from the group consisting of iron, nickel, cobalt and alloys of these metals.

16. An electrolyser according to claim 1, in which said anode comprises a plurality of vertical metal sheets which are spaced from one another and are affixed transversely to one of said plates of said common vertical wall.

17. An electrolyser according to claim 1, in which said cathode comprises a plurality of vertical metal sheets which are spaced from one another and are affixed transversely to one of said plates of said common vertical wall.

* * * * *